US005597521A

United States Patent [19]

Wickham

[11] Patent Number: 5,597,521

[45] Date of Patent: Jan. 28, 1997

[54] UNLOADER-SEPARATOR

[76] Inventor: John L. Wickham, 11752 Harford Rd., Glen Arm, Md. 21057

[21] Appl. No.: 488,504

[22] Filed: Jun. 9, 1995

[51] Int. Cl.[6] ..... B29C 45/42; B29C 45/00; B22D 17/00; B22D 29/04

[52] U.S. Cl. ..... 264/37; 264/40.1; 264/161; 264/297.2; 264/328.8; 264/334; 425/136; 425/217; 425/556; 425/572; 425/444; 425/DIG. 5; 425/DIG. 51; 164/5; 164/70.1; 164/262; 164/404

[58] Field of Search ..... 164/5, 70.1, 129, 164/131, 262, 265, 303, 344, 404; 264/37, 40.1, 297.2, 328.7, 328.8, 334, 336, 157, 161; 425/136, 215, 216, 217, 554, 556, 588, 572, 444, DIG. 5, DIG. 51

[56] References Cited

U.S. PATENT DOCUMENTS

| | | | |
|---|---|---|---|
| 2,569,083 | 9/1951 | Wilhelm | 164/70.1 |
| 2,848,770 | 8/1958 | Schuchardt | 164/265 |
| 3,354,942 | 11/1967 | Todd et al. | 164/344 |
| 3,407,444 | 10/1968 | Rees | 264/37 |
| 3,408,689 | 11/1968 | Heiner | 425/556 |
| 3,418,694 | 12/1968 | Strauss | 264/37 |
| 3,669,592 | 6/1972 | Miller | 425/556 |
| 4,204,824 | 5/1980 | Paradis | 425/444 |
| 4,295,815 | 10/1981 | Eltvedt | 425/444 |
| 4,585,260 | 4/1986 | Skovajsa | 164/404 |
| 4,592,407 | 6/1986 | Yamaguchi et al. | 164/5 |
| 4,795,124 | 1/1989 | Nagai | 164/344 |

*Primary Examiner*—Jill L. Heitbrink
*Attorney, Agent, or Firm*—Leonard Bloom

[57] ABSTRACT

An unloader-separator attached to a die casting machine which includes a swing arm having grippers to hold the gate having components thereon. The swing arm holding the gate is rotated to a second position. A punch platen pushes the components through openings in the window platen which corresponds with the components on the gate. The swing arm releases the gate remnants for recycling, rotates to the first position and the cycle repeats. A link arm connects the swing arm to a cam unit which controls the rotation of the swing arm to a cam unit which controls the rotation of the swing arm. The cam unit also provides overload protection.

12 Claims, 5 Drawing Sheets

UNLOADER-SEPARATOR

FIELD OF THE INVENTION

The present invention relates to an unloader-separator for casting and moldings from a die casting machine or plastic molding machine and more particularly, to a device which automatically unloads a gate from the die casting machine and separates components from the gate.

BACKGROUND ART

When producing castings and moldings, it is very common practice in industry to form a plurality of components within the same die, all of the components being removably attached to a gate (or tree). The components may be identical or may be of different shapes depending upon the nature of the operation.

Generally, the die casting or molding machine is operated at maximum capacity on a full automatic cycle. As long as the furnace attached to the casting or molding machine has molten material (metal or plastic) in the furnace, the die casting or molding machine will repetitively produce the desired gate without human intervention. Following each cycle, a gate consisting of sprue, runner, overflow and desired components is removed from the machine. The gate must be removed rapidly and the removal apparatus must be available for a subsequent removal in as little as 5 seconds to accommodate the rapid cycle of casting the gate.

In high volume production, the gate must be moved rapidly from the immediate vicinity of the die casting machine or molding to avoid an accumulation and jamming of the machine. Manual unloading is usually able to keep up with the production rate only with great difficulty. Often, the gates are merely ejected and allowed to slide down a chute. In these instances, the gates must subsequently be held or otherwise constrained to remove the desired components from the unusable parts of the gate. Robots have been used to unload the gate from the die and feed the gate to a "trim die" such as a vertical press to remove the components from the gate. Robot systems are very expensive and, consequently, are used only where production quantities are large enough to make the use of robots economically feasible. With large sized components, the components are frequently removed manually from the gate. If the gate has different types of components, the components are frequently sorted manually and like components are deposited in drums. The scrap material such as the runner, sprue and overflow are generally removed from the immediate work site, accumulated and subsequently returned to the furnace for remelt.

There is a need for a simple, inexpensive automatic device to attach to the die casting or molding machine to unload the gate, separate the components from the gate, convey the parts to separate containers and convey the scrap back to the furnace before the scrap cools to room temperature.

SUMMARY OF THE INVENTION

It is an object of the present invention to provide an unloader-separator to be attached to a die casting or molding machine to automatically and rapidly remove gates from the die, separate components from the gate, and immediately return scrap (gate remnants) to the furnace of the die casting machine.

It is a further object of the present invention to provide a means to protect the unloader-separator from damage in the event of a malfunction.

It is still a further object of the present invention to provide an unloader-separator which is inexpensive to produce and operate.

It is yet another object of the present invention to provide an unloader-separator which can be used with gates having different components.

Accordingly, in accordance with the teachings of the present invention, there is disclosed herein an unloader-separator for castings and moldings, the castings and moldings being a plurality of spaced-apart components removably connected to a gate formed in a die casting machine. The unloader-separator is connected to the die casting machine and includes a swing arm having a first end and a second end. The first end is rotatably connected to a support means. The second end has a pair of spaced-apart gripper means attached thereto. The swing arm is rotatable between a first position and a second position. The gate has a pair of spaced-apart extracting means formed thereon, the extracting means being releasably gripped by the gripper means on the swing arm. A link arm has a first end and an opposite second end. The first end is connected to the swing arm, and the second end is connected to a cam unit having a cam therein. Means are provided for rotating the cam, wherein the link arm moves the swing arm alternately between the first position and the second position. A window platen is disposed adjacent to the second position of the swing arm. The window platen has a plurality of openings formed therein, the openings corresponding with the plurality of spaced-apart components on the gate. A punch platen is disposed opposite the window platen, the punch platen having a plurality of punch rods extending outwardly therefrom and oriented toward the window platen. Each punch rod corresponding with a respective component on the gate. Means are provided for moving the punch platen toward the swing arm holding the gate in the second position of the swing arm, wherein the plurality of punch rods push the plurality of components off of the gate and through the respective openings in the window platen. In this manner, the unloader-separator grips a gate in the die casting machine, moves the gate outside the die casting machine, removes the components from the gate and repeats the cycle.

In another aspect, a method of using the unloader-separator is disclosed.

These and other objects of the present invention will become apparent from a reading of the following specification, taken in conjunction with the enclosed drawings.

DESCRIPTION OF THE PREFERRED EMBODIMENT

Figure 1:
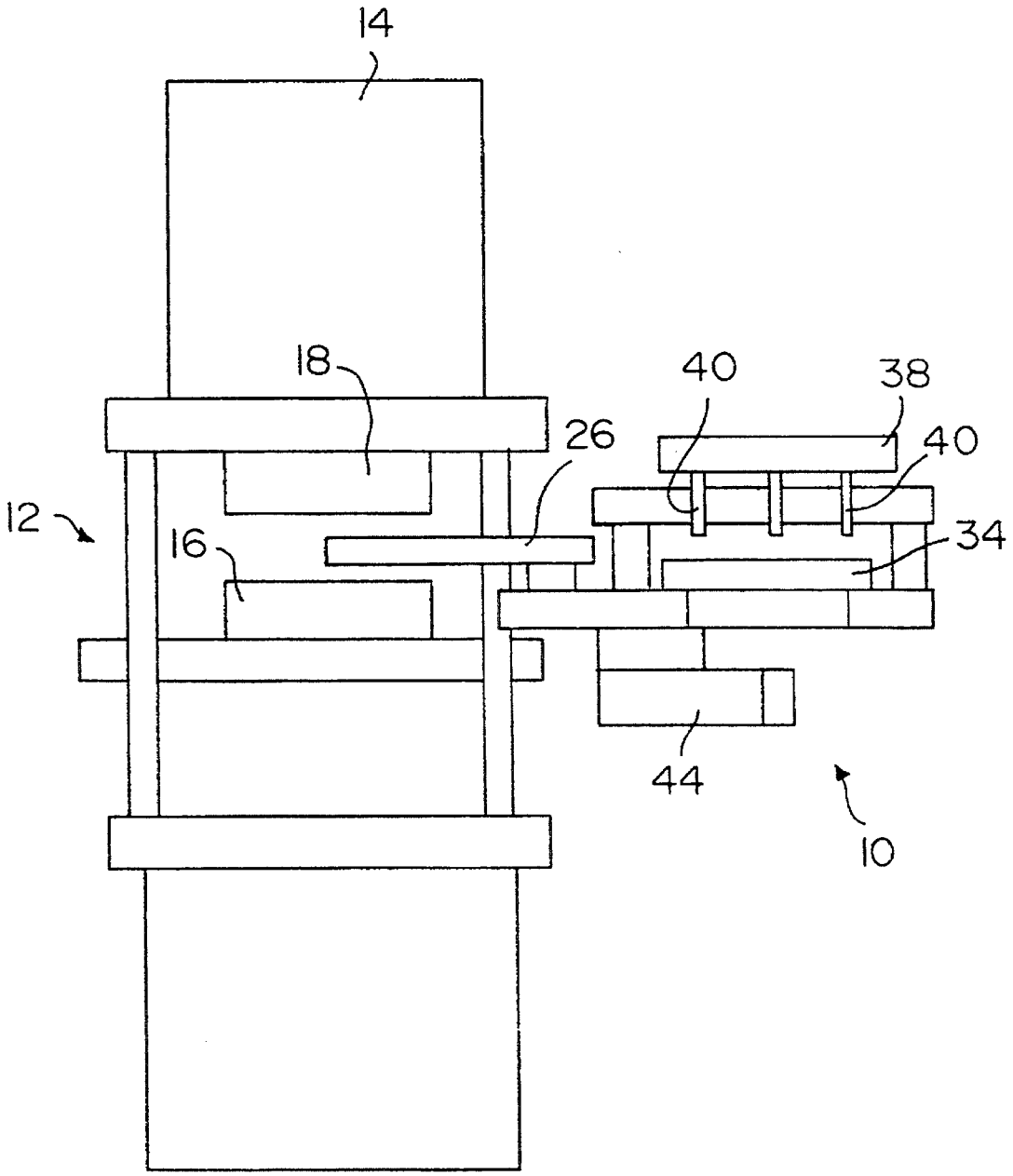
FIG. 1 is a top plan view of the unloader-separator connected to the die casting machine.
Figure 2:
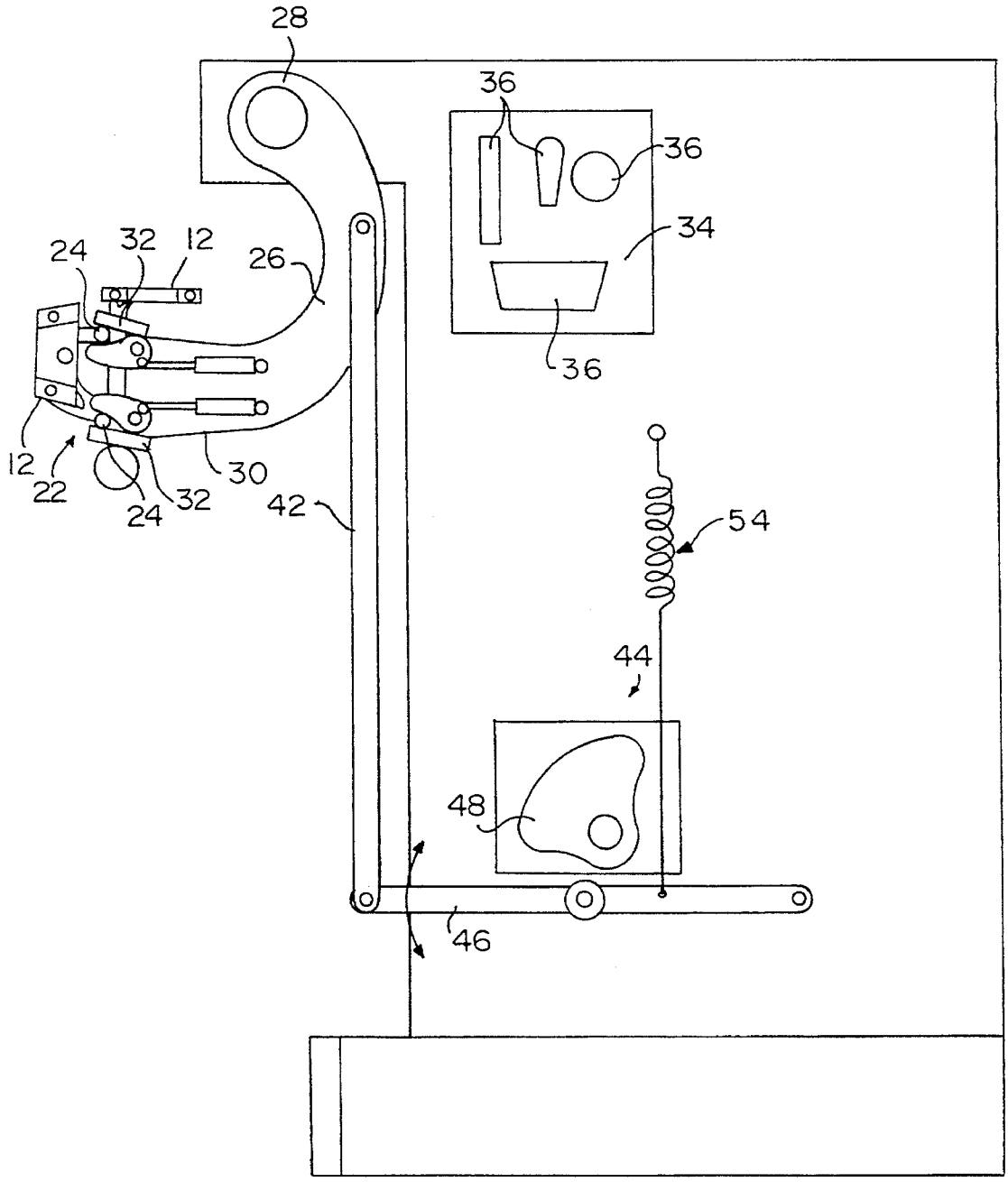
FIG. 2 is a diagrammatic view of the unloader-separator.
Figure 3:
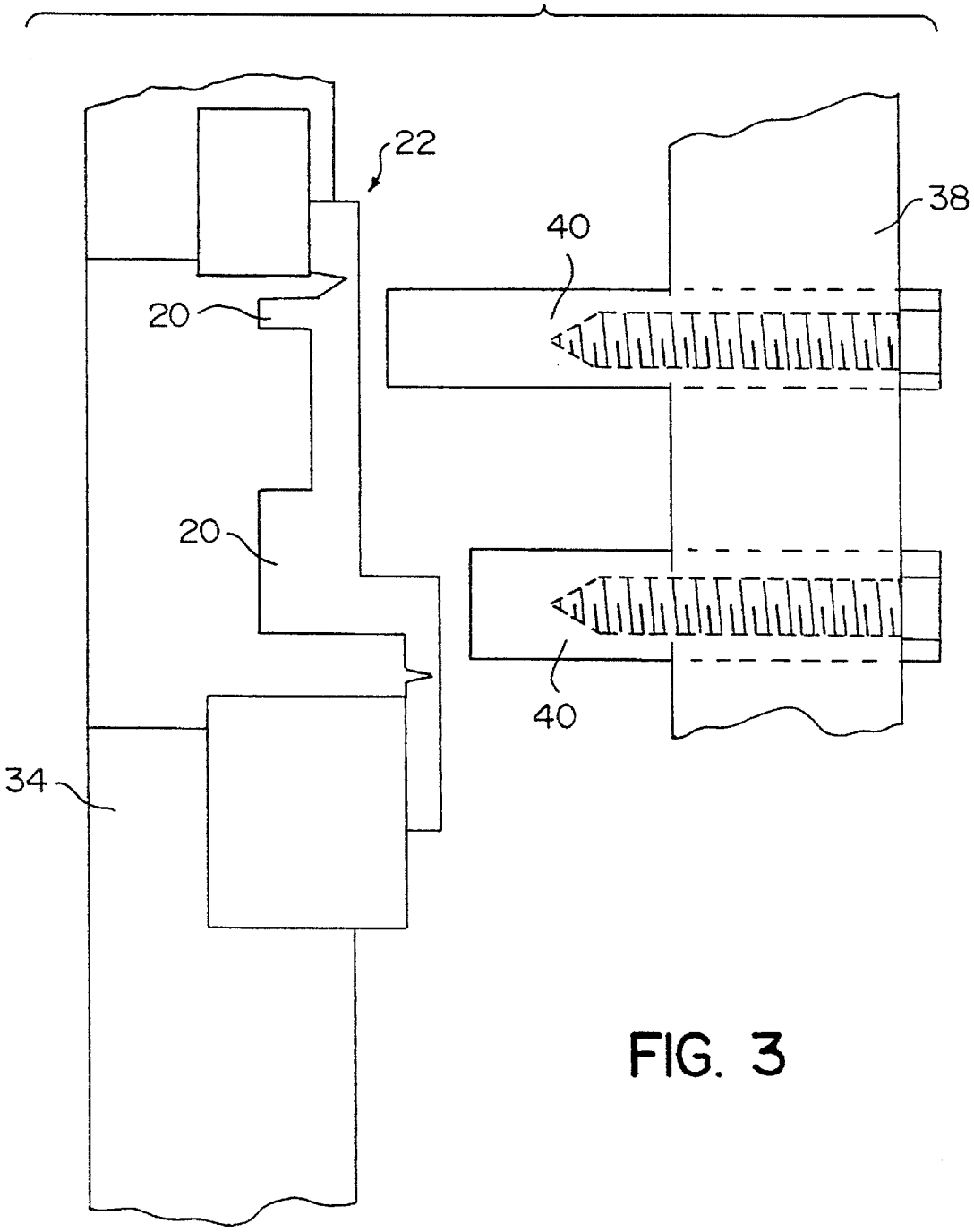
FIG. 3 is an enlarged view of the punch platen pushing the components from the gate and through the window platen.
Figure 4:
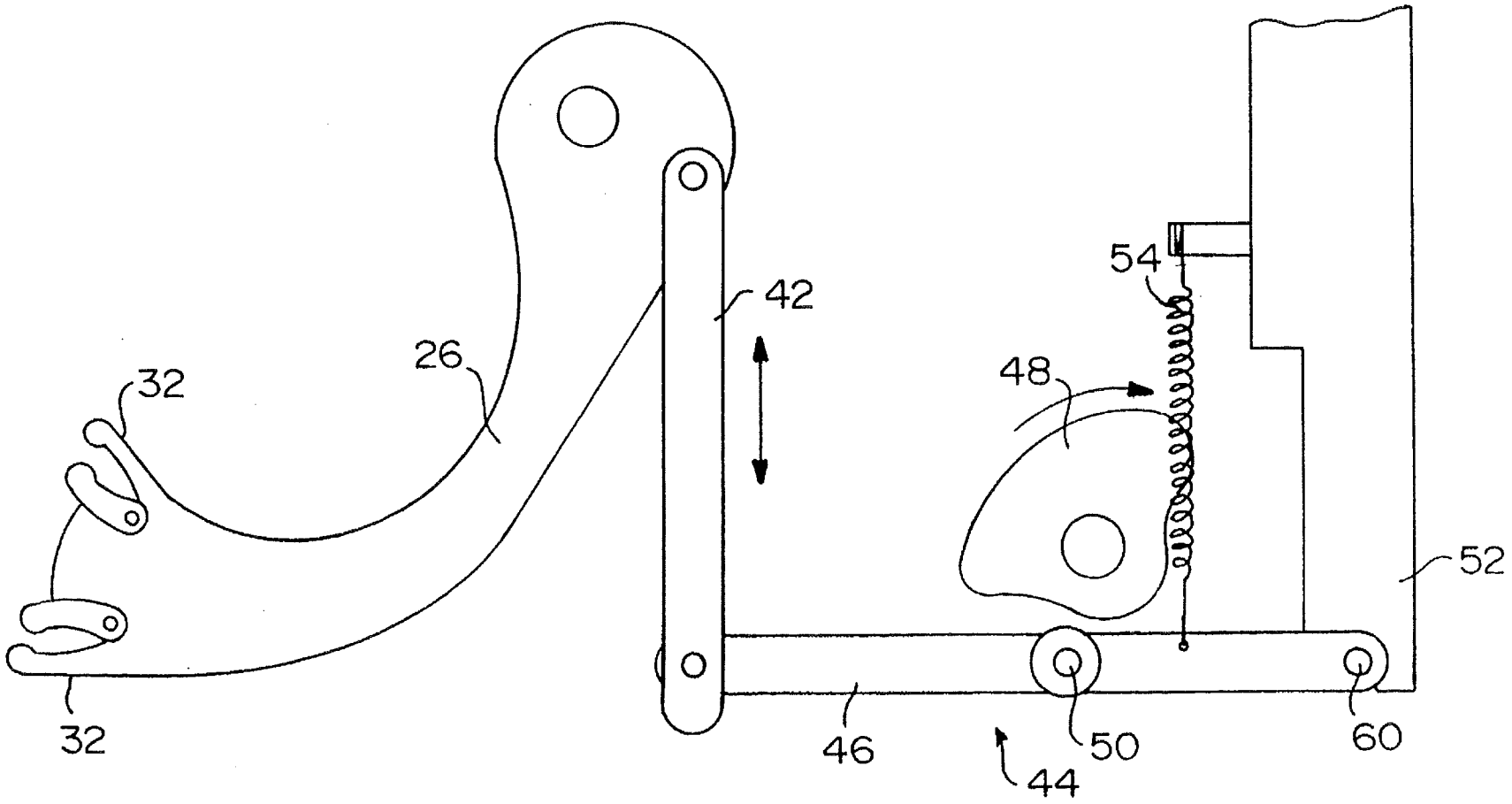
FIG. 4 is a diagrammatic view of the swing arm connected to the cam unit.
Figure 5:
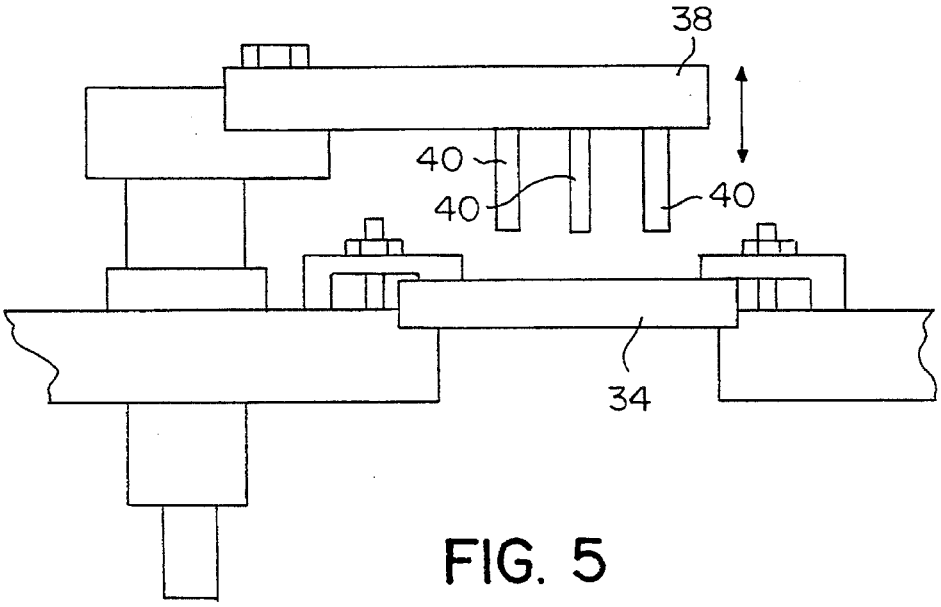
FIG. 5 is a top plan view of the replaceable window platen and punch platen mounted on the unloader-separator.
Figure 6:
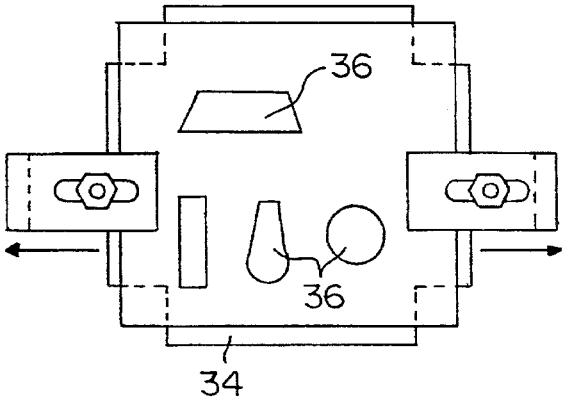
FIG. 6 is an elevation view of the removable window platen.
Figure 7:
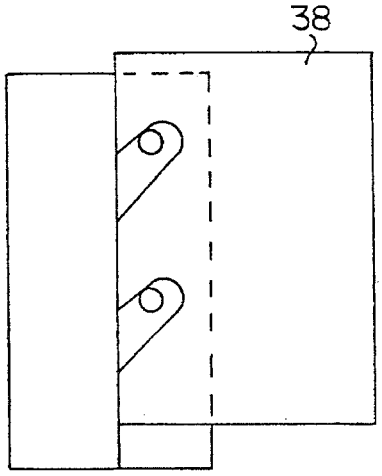
FIG. 7 is an elevation view of the removable punch platen.

With reference to FIGS. 1–4, the unloader-separator 10 is attached directly to the die casting machine. In the present application, the term "die casting machine" includes molding machines and is useable with metal or plastic material. The die casting machine 12 has a furnace 14 in which the material to be cast is melted. The material to be cast may be metal or plastic. A metal frequently used is a zinc alloy which has a melting point of approximately 800° F. Other molten metals cool less rapidly, reducing the rate of formation of the cast form. A wide variety of plastics may be used.

The die casting machine 12 has an ejector die 16 and a cooperating cover die 18 which are separable. The dies 16, 18 are held together under high pressure within the die casting machine 12 while molten material is introduced into the plurality of spaced-apart cavities formed in the dies 16, 18. The cavities are formed in the shapes of the desired components 20 and are interconnected in the die by a runner so that the overall cast unit forms a gate 22 (or "tree"). A sprue is also formed connected to the runner. The components 20 are connected to the runner by a very thin connector so that the components are easily removable from the runner with minimal force. Also formed on the gate 22 are a pair of extracting means 24 which are spaced apart by a predetermined distance, the function of which will be described. The extracting means 24 include protrusions of any sort from the gate, or specific portions on the gate, which are intentionally formed at a predetermined distance from one another. When the molten material in the dies 16, 18 cools sufficiently, the dies 16, 18 are separated from one another to enable the gate 22 to be removed.

The unloader-separator 10 has a swing arm 26 which has a first end 28 and a second end 30. The first end 28 is rotatably connected to the die casting machine 12 or to a separate support means immediately adjacent to the die casting machine 12. The swing arm 26 is rotatable between a first position, in which the second end 30 is disposed between the separated cover die 18 and ejector die 16 in the die casting machine 12 and a second position, in which the second end 30 is disposed outside the die casting machine 12. The second end 30 has a pair of spaced apart gripper means 32 formed thereon. The gripper means 32 are preferably a set of jaws which are capable of being opened and closed remotely by mechanical, electrical, hydraulic or pneumatic means. The gripper means 32 grip the extracting means 24 such that the gate 22 may be removed from between the separated dies 16, 18 when the second end 30 of the arm 26 is moved outwardly from the die casting machine 12. The gripper means 32 preferably are spaced apart by a predetermined distance which is equal to the predetermined distance between the extracting means 24. In this manner, the gate 22 is removed from the die casting machine 12 irrespective of the size of the gate 22 or of the number, size, orientation and shape of the components 20 which are connected to the gate 22.

After the extracting means 24 on the gate 22 are gripped by the gripper means 32 on the swing arm 26, the swing arm 26 is moved axially from between the ejector die 16 and cover die 18 and out of the die casting machine 12. This breaks the gate loose from the die, a relatively weak connection having been retained up to this point in the sequence of operations. The swing arm 26 is then rotated to the second position, dwells there, and preferably is moved axially toward the die casting machine 12.

Disposed immediately adjacent to the second position of the swing arm 26 is a window platen 34. The window platen 34 has a plurality of spaced-apart openings 36 formed therein. The openings 36 are formed in shapes, and are spaced apart, to correspond with the components 20 which are attached to the runner.

A punch platen 38 is disposed opposite to the window platen 34. A plurality of spaced-apart punch rods 40 are connected to the punch platen 38, the rods 40 extending outwardly from the punch platen 38 and oriented toward the window platen 34. The punch rod 40 may have the shape of a block, bar or similar structure. Each punch rod 40 corresponds with a respective component 20 on the gate 22. When the punch platen 38 is moved by mechanical, electrical, hydraulic or pneumatic means toward the second position of the swing arm 26, where the swing arm 26 is holding the gate 22 on tooled supports, the respective punch rods 40 on the punch platen 38 strike the components 20 and push the components 20 off of the gate 22 and through the respective corresponding openings 36 in the window platen 34. If necessary the runner of the gate 22 may be restrained with a clamp or spring-loaded pins before the punch rods 40 contact the components 20. After the components 20 are removed from the gate 22, the punch platen 38 is retracted.

After removal of the components 20, the swing arm 26 is axially moved away from the window platen 34 to the second position and rotated to the first position. The swing arm 26 is moved axially into the space between the ejector die 16 and the cover die 18 to grip the extracting pins 24 and the cycle is repeated. The entire cycle may be only 4½ to 6 seconds or may be much longer and during this period, the molten material is introduced in the die, the molten material cools sufficiently to form a gate which can be removed from the ejector die 16 and the cover die 18, and the swing arm 26 moves from the first position to the second position and returns.

The window platen 34 and the punch platen 38 are each replaceable so that the unloader-separator 10 may be used with any size, shape and orientation of components 20. Thus, the openings 36 are selected to be in registration with the components 20 and the punch rods 40 are selected to correspond with the components 20 between any pair of matched window platen 34 and punch platen 38. The extracting means 24 are always disposed at the same locations on the gate 22, being spaced apart by an unchanging distance irrespective of the type or location of the components 20 on the gate 22. Thus, the gripper means 32 on the swing arm 26 do not need to be changed or modified in any way when the window platen 34 and the punch platen 38 are replaced. In this manner, the versatility of the unloader-separator 10 is increased and the cost of the unloader-separator 10 is minimized.

In a preferred embodiment the window platen 34 and the punch platen 38 are each attached to the unloader-separator 10 by a pair of nuts or easily removable connector means and a wrench which fits the nuts is conveniently hung on the die casting machine 10 to loosen the nuts for removal of one set of platens and to tighten the nuts to retain a substitute set of platens. A complete changeover can be completed in approximately two (2) minutes.

Preferably, a separate first conveyor system usually consisting of a simple chute (not shown) is disposed under each opening 36 so that the separate components are conveyed to separate storage containers and no further sorting is required. If identical components 20 are formed on the gate, a single first conveyor system for all of the components 20 may be used since there is no need for separation of the components after removal from the gate 22.

A second conveyor system (not shown) is disposed under the front surface of the window platen 34 where the swing arm 26 is holding the gate 22. After removal of the components 20 from the gate 22, the gripper means 32 on the second end 30 of the swing arm 26 release the extracting means 24 and the remnants of the gate 22 (i.e., the runner, extracting pins and sprue) drop onto the second conveyor system and are conveyed to the furnace 14. The remnants of the gate 22 (the scrap material) is automatically recycled before it has cooled to room temperature and, preferably, the scrap is still hot since the total time elapsed following casting of the molten material is less than one minute. Where zinc alloy is used as the casting material, the scrap metal is approximately 600° F. when it is recycled into the furnace 14. In this manner, the present invention is not only saving casting material, but is providing a significant savings in energy since the scrap material requires much less energy to heat to a molten state as compared to scrap at room temperature. The present invention also produces a savings in labor because there is no need for manual sorting of the components 20 nor is there any manual operations with the scrap material. In actuality, the scrap material is too hot for manual operations. The present invention provides these advantages because the unloader-separator 10 is directly connected to the die casting machine 12 in close proximity to the furnace 14 and the unloader-separator 10 is operating on an extremely short cycle wherein the cast material cools very little before it is returned to the furnace 14.

A link arm 42 has a first end connected to the swing arm 26 and a second, opposite end at a distance from the first position of the swing arm 26 such that the link arm 42 is approximately parallel to the die casting machine 12. The second end of the link arm 42 is connected to a cam unit 44. The cam unit 44 has a follower arm 46, a cam follower 50, a pivot block 56 and a resilient means 58. The second end of the link arm 42 is connected to the first end of the follower arm 46. At approximately the midpoint of the follower arm 46 a cam follower 50 is rotatably mounted. The cam follower 50 is in direct contact with the outer perimeter of the cam 48. The outer perimeter of the cam 48 is formed so that the cam follower 50 is moved in a pattern wherein the follower arm 46 produces leverage on the link arm 42 to rotate the swing arm 26 between the first position and the second position. The dwell time in the first position and the second position are determined by the configuration of the cam 48 and the rate of rotation of the cam 48. The cam 48 is driven by a motor or motor-clutch arrangement that is synchronized with the die casting machine 12. On the second end of the follower arm 46, there is connected a spacer 60. The spacer 60 is received in a notch in the pivot block 56 The resilient means 58 is connected to the follower arm 46 at an appropriate point between the midpoint and the second end. The resilient means 58, which may be a coil spring, has an opposite end connected to an anchor. The resilient means 58, urges the cam follower 50 against the cam 48 and also urges the spacer 60 into the notch in the pivot block 56. A weight or gravity dependent system might serve as the resilient means to urge the cam follower 50 and spacer 60.

The function of the spacer 60, the notch in the pivot block 56 and the resilient means 58 is to provide overload protection to the unloader-separator 10. In the event that a malfunction, such as jamming of the dies, improper gripping of the gate, improper release of the gate, jamming of the punch platen, or breakage of any of the members, the swing arm 26 would not rotate between the first position and the second position. In this event, the second end of the follower arm 46 would be moved against the urging of the resilient means 58 and the spacer 60 would be displaced from the notch in the pivot block 56. A sensor (not shown), such as a switch or optical monitor, detects the displacement of the spacer 60 from the notch in the pivot block 56 and the power to the unloader-separator is interrupted so that the system is not damaged. The overload protection is inexpensive and provides a positive control.

The cam 48 also actuates means for axially moving the swing arm 26. The means for axially moving the swing arm 26 may be mechanical, electrical, pneumatic or hydraulic.

In summary, the unloader-separator of the present invention provides an integrated unit which unloads the gate from the die casting machine, separates the components and recycles the scrap material to the furnace of the die casting machine. The unloader-separator operates at a rate to maintain the production of the cast components within the cycle of the die casting machine without impeding access to the die casting machine. The unloader-separator is compact and is directly connected to the die casting machine. In a production facility where there are a number of die casting machines, the compactness of the unloader-separator does not require the adjacent die casting machines to be spaced apart at a distance greater than the spacing without the unloader-separator. The components removed from the gate are separated from each other as well as from the scrap material. The scrap material drops away from the die casting machine and is automatically conveyed to the furnace while the scrap material retains heat, thereby saving energy to remelt the scrap. The unloader-separator is very versatile being capable of unloading and separating a variety of different die sets and requiring only replacement of the window platen and the punch platen. The window platen and the punch platen are inexpensive. A changeover can be effected within several minutes. The unloader-separator requires very little maintenance. Hydraulic or pneumatic activation of moving parts can be initiated by the cam.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An unloader-separator for castings and moldings, the castings and moldings being a plurality of spaced-apart components removably connected to a gate formed in a die casting machine, the unloader-separator being connected to the die casting machine and comprising:

a swing arm having a first end and a second end, the first end being rotatably connected to a support means, the second end having a pair of spaced-apart gripper means attached thereto, the swing arm being rotatable between a first position and a second position, the gate having a pair of spaced-apart extracting means formed thereon, the extracting means being releasably gripped by the gripper means on the swing arm, a link arm having a first end and an opposite second end, the first end being connected to the swing arm, the second end being connected to a cam unit having a cam therein, means for rotating the cam, wherein the link arm moves the swing arm alternately between the first position and the second position, a window platen disposed adjacent to the second position of the swing arm, the window platen having a plurality of openings formed therein, the openings corresponding with the plurality of spaced-apart components on the gate, a punch platen disposed opposite the window platen, the punch platen having a plurality of punch rods extending outwardly therefrom and oriented toward the window platen, each punch rod corresponding with a respective component on the gate, means for moving the punch platen toward the swing arm holding the gate in the second position of the swing arm, wherein the plurality of punch rods push the plurality of components off of the gate and through the respective openings in the window platen, such that the unloader-separator grips a gate in the die casting machine, moves the gate outside the die casting machine, removes the components from the gate and repeats the cycle.

2. The unloader-separator of claim 1, wherein a furnace is attached to the die casting machine, the unloading-separator further having automatic means for immediately conveying the gate to the furnace for recycling of the gate after the plurality of components have been removed from the gate and before the gate has cooled to room temperature, thereby reducing energy needs and reducing manual operations.

3. The unloader-separator of claim 1, wherein the window platen and the punch platen are replaceable such that the openings in the window platen and the punch rods on the punch platen correspond with components on the gate.

4. The unloader-separator of claim 1, wherein the cam unit has a cam follower in contact with the cam, the cam follower being rotatably connected to an approximate midpoint of a follower arm, the follower arm having a first end and a second end, the first end of the follower arm being connected to the second end of the link arm, the second end of the follower arm having a spacer attached thereto, a pivot block having a notch therein disposed adjacent to the second end of the follower arm such that the spacer on the follower arm is received in the notch in the pivot block, a resilient means connected to the follower arm between the midpoint and the second end of the follower arm, the resilient means urging the spacer into the notch in the pivot block and urging the cam follower against the cam such that the link arm moves the swing arm alternately between the first position and the second position.

5. The unloader-separator of claim 4, further comprising a sensor monitoring the disposition of the spacer in the notch in the pivot block, the sensor interrupting power to the unloader-separator when the spacer is displaced from the notch due to malfunction.

6. The unloader-separator of claim 1, wherein the window platen and the punch platen are both replaceable such that the unloader separator is used with gates having components of differing shapes, sizes and orientation.

7. A method of automatically unloading from a die casting machine, a gate having a plurality of spaced-apart components removably connected thereto and separating said components from one another, the method comprising the steps of:

moving a swing arm having gripper means thereon into the opened die casting machine and gripping a pair of spaced-apart extracting means on the gate, moving the swing arm gripping the gate out of the die casting machine, rotating the swing arm and aligning the gate with a window platen having a plurality of openings therein, moving a cooperating punch platen having punch rods attached thereto toward the gate and punching the components off of the gate and through the respective openings in the window platen, conveying the separated components away from the die casting machine, releasing the grip on the gate, dropping the gate onto a conveyor means and, before the gate cools to room temperature, conveying the gate to a furnace attached to the die casting machine wherein the gate is melted and recycled in the die casting machine, and repeating the above steps.

8. The method of claim 7, wherein the steps are repeated in approximately 4 to 6 seconds.

9. The method of claim 7, wherein a cam and cam unit having a sensor, control the rotation of the swing arm, further comprising the step of the sensor monitoring the movement of the cam unit such that a malfunction in the steps produces an interruption in power to unloader-separator.

10. The method of claim 7, further comprising replacing the window platen and the cooperating punch platen with a substitute window platen and a substitute cooperating punch platen such that the unloader-separator is used with a substitute gate having a plurality of substitute components removably connected thereto.

11. The method of claim 7, further comprising the step of moving the swing arm axially from the opened die casting machine after the extracting pins are gripped, facilitating removal of the gate from the die casting machine.

12. The method of claim 7, further comprising the step of moving the swing arm axially toward the window platen and supporting the gate on a support means.

* * * * *